US005675348A

United States Patent [19]

Okada et al.

[11] Patent Number: 5,675,348

[45] Date of Patent: Oct. 7, 1997

[54] FEEDOME, PRIMARY RADIATOR, AND ANTENNA FOR MICROWAVE

[75] Inventors: Yasuhiro Okada, Saitama; Keiji Fukuzawa, Chiba, both of Japan

[73] Assignee: Sony Corporation, Tokyo, Japan

[21] Appl. No.: 649,053

[22] Filed: May 16, 1996

[30] Foreign Application Priority Data

May 17, 1995 [JP] Japan ..... 7-118040
Aug. 14, 1995 [JP] Japan ..... 7-206901

[51] Int. Cl.[6] ..... H01Q 1/42; H01Q 13/02

[52] U.S. Cl. ..... 343/781 R; 343/786; 343/872

[58] Field of Search ..... 343/786, 753, 343/756, 781 R; H01Q 13/00, 13/02, 1/42

[56] References Cited

U.S. PATENT DOCUMENTS 4,963,878 10/1990 Kildal ..... 343/786
5,103,237 4/1992 Weber ..... 343/786
5,166,698 11/1992 Ashbaugh et al. ..... 343/786

*Primary Examiner*—Michael C. Wimer
*Attorney, Agent, or Firm*—William S. Frommer; Alvin Sinderbrand

[57] ABSTRACT

A feedome is disposed on the side of an opening of a radiator main body, and comprises a dielectric board having a thickness sufficiently smaller than the wavelength of radio wave, and a dielectric protrusion fixedly mounted to the dielectric board substantially in the center of the inner side thereof, and having a height approximately equal to integral number times (½)·λ where the wavelength of radio wave is λ, and a diameter approximately equal to the height of the dielectric protrusion.

15 Claims, 6 Drawing Sheets

FEEDOME, PRIMARY RADIATOR, AND ANTENNA FOR MICROWAVE

BACKGROUND OF THE INVENTION

The present invention relates to an antenna for microwave which is used for a receiving of a telecommunication by satellite and a broadcast satellite communication and more particularly, to an improvement of a feedome (abbreviation of "feed horn dome") thereof.

A Cassegrainian antenna and an offset antenna are enumerated as a parabolic antenna which is a kind of antenna for microwave. The offset antenna comprises a reflector for reflecting radio wave, a primary radiator disposed in the vicinity of a focused position of a radio wave or waves reflected by the reflector, and a converter for ensuring frequency conversion of the radio wave taken in the primary radiator. The primary radiator comprises a radiator main body having an opening on which radio wave is incident, and to which a feedome is generally mounted to prevent a penetration of rainwater, dust, etc. However, mounting of the feedome has the following effect:

Radio wave I radiated by the radiator main body and incident on the feedome is decomposed into an electric power R which reflects on the side of the radiator main body, and an electric power T which passes through the feedome. Except when the feedome is very thin, and has a relative dielectric constant in the order of 2, a reflection loss defined by an electric power ratio R/I of the incident radio wave I to the reflected radio wave R is generally increased by mounting the feedome, resulting in lowered gain of the antenna.

It is noted that, in order to decrease a reflection loss of the primary radiator with the feedome, the following measures are taken conventionally. The first measure is to construct the feedome in the form of a very thin film, which is disposed to be in close contact with the opening of the radiator main body or adjacent thereto. The second measure is to construct the feedome to be sufficiently thinner than the wavelength of radio wave, which is disposed in a position substantially a half wavelength ($\lambda_0$: atmospheric wavelength) distant with respect to the opening of the radiator main body. The third measure is to construct the feedome to have a thickness of substantially half wavelength ($\lambda$: wavelength in the feedome), which is disposed in a position substantially a half wavelength ($\lambda_0$: atmospheric wavelength) distant with respect to the opening of the radiator main body. The second and third measures are based upon a theory, as described in the "ELECTROMAGNETIC THEORY", pp. 511–515, J. A. Stratton, published by McGRAW-HILL Book Company in 1941, that, when the thickness of air or dielectric is a half of the transmitted wavelength, a reflection loss of radio wave transmitting through the medium is minimum.

However, the above conventional measures produce the following problems. The first measure produces a problem of easy breakage, etc. due to extremely small thickness of the feedome, resulting in its unpracticality when being set out of doors. The second measure produces a problem of enlarged size of the primary radiator since the feedome is disposed distant from the opening of the radiator main body. The third measure produces a problem of not only further enlarged size than that of the second measure, but increased weight due to large thickness of the feedome itself.

It is, therefore, an object of the present invention to provide a feedome, etc. which present excellent reflection loss characteristic and sufficient strength, and contribute to a reduction in size and weight of a primary radiator.

SUMMARY OF THE INVENTION

According to one aspect of the present invention, there is provided a feedome, comprising:

a dielectric board having a thickness sufficiently smaller than a wavelength of radio wave, said dielectric board having a first side; and a dielectric protrusion fixedly mounted to said dielectric board substantially in a center of said first side thereof, said dielectric protrusion having a height approximately equal to an integral number times $(1/2)\cdot\lambda$ where said wavelength of radio wave is $\lambda$, and a diameter approximately equal to said height of said dielectric protrusion.

Another aspect of the present invention lies in providing a primary radiator, comprising:

a main body having an opening on which radio wave is incident; and a feedome disposed on a side of said opening of said main body, said feedome comprising:

a dielectric board disposed with respect to said opening of said main body and having a thickness sufficiently smaller than a wavelength of radio wave, said dielectric board having a first side; and a dielectric protrusion fixedly mounted to said dielectric board substantially in a center of said first side thereof, said dielectric protrusion having a height approximately equal to an integral number times $(1/2)\cdot\lambda$ where said wavelength of radio wave is $\lambda$, and a diameter approximately equal to said height of said dielectric protrusion.

The other aspect of the present invention lies in providing an antenna for microwave, comprising:

a reflector arranged to reflect radio wave; and a primary radiator disposed with respect to said reflector, said primary radiator receiving radio wave reflected by the reflector, said primary radiator comprising a main body having an opening, and a feedome disposed on a side of said opening of said main body, said feedome comprising:

a dielectric board disposed with respect to said opening of said main body and having a thickness sufficiently smaller than a wavelength of radio wave, said dielectric board having a first side; and a dielectric protrusion fixedly mounted to said dielectric board substantially in a center of said first side thereof, said dielectric protrusion having a height approximately equal to an integral number times $(1/2)\cdot\lambda$ where said wavelength of radio wave is $\lambda$, and a diameter approximately equal to said height of said dielectric protrusion.

DETAILED DESCRIPTION OF THE INVENTION

Figure 1A:
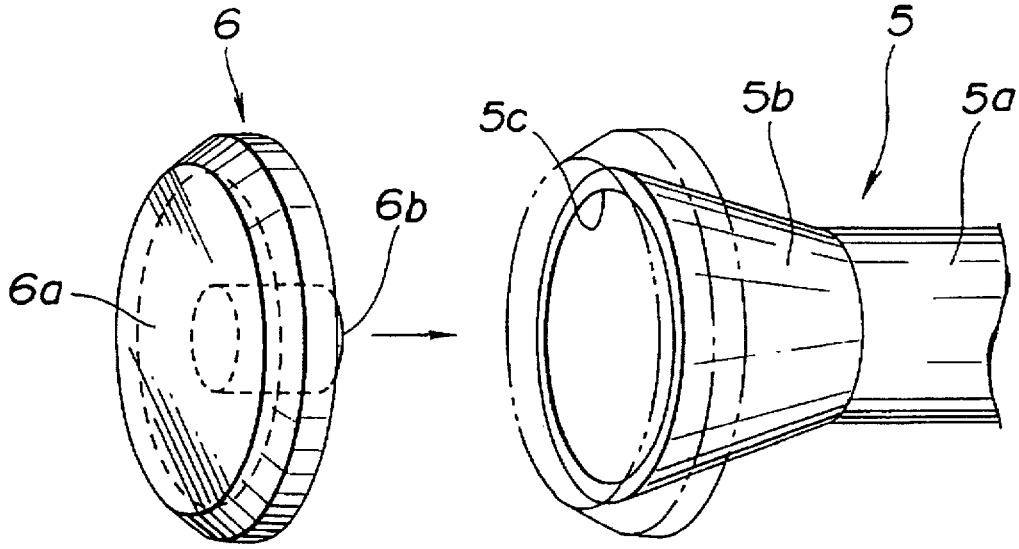
FIG. 1A is an exploded perspective view showing a primary radiator according to the present invention.

Referring to FIGS. 1A to 5, a preferred embodiment of the present invention will be described. Referring first to FIGS. 2A and 2B, an antenna for microwave comprises a reflector a 1 for reflecting radio wave or waves, which is fixedly mounted to a support 3 through a mounting portion 2. An inner surface of the reflector 1 formes a paraboloid of revolution, or a parabola. A primary radiator 4 is disposed substantially in a focused position of the radio wave reflected by the paraboloid of revolution.

The primary radiator 4 comprises a radiator main body 5 and a feedome (abbreviation of "feed horn dome") 6, the radiator main body 5 being fixedly mounted to the mounting portion 2 through a mounting arm portion 7. Moreover, a converter 8 is fixedly mounted to a rear end surface of the radiator main body 5.

Figure 1B:
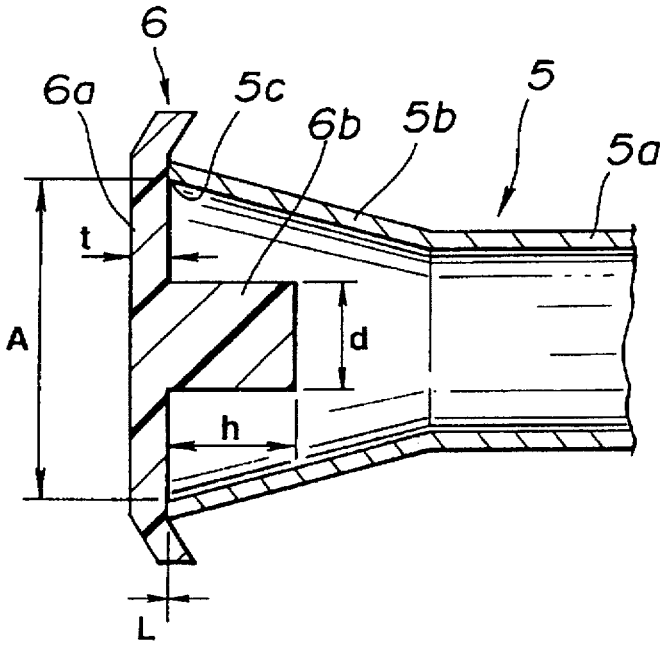
FIG. 1B is a sectional view showing the primary radiator.
Figure 2A:
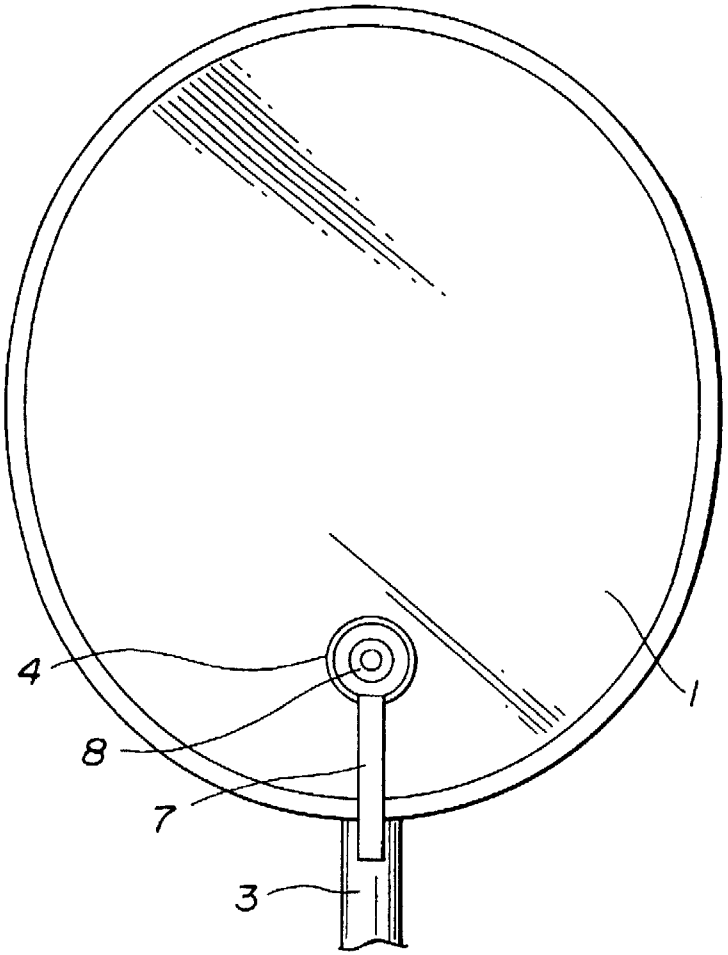
FIG. 2A is a fromt view showing an antenna for microwave according to the present invention.
Figure 2B:
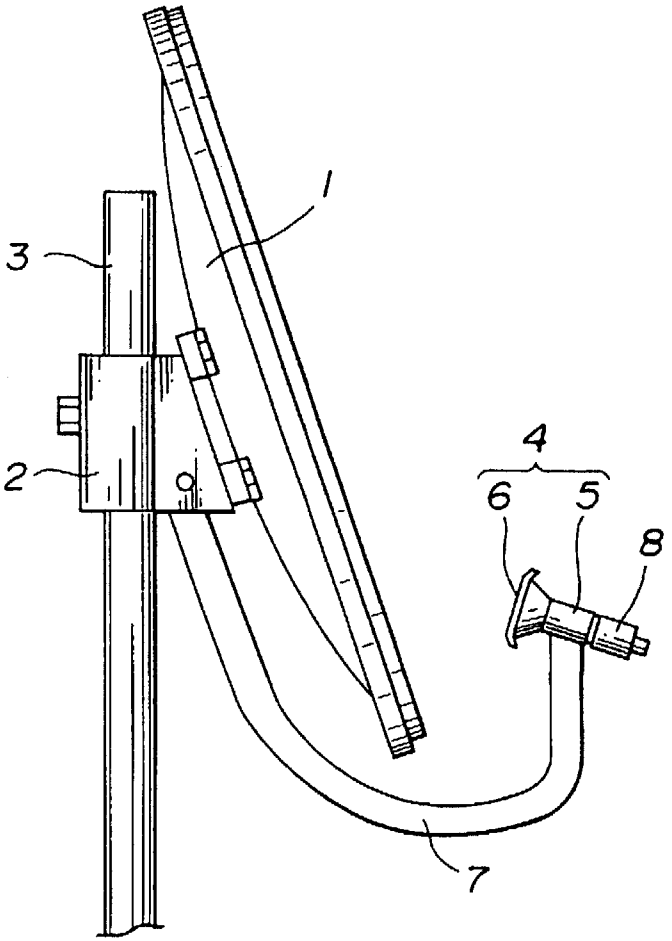
FIG. 2B is a side view of the antenna for microwave.

Referring to FIGS. 1A and 1B, the radiator main body 5 includes a circular wave guide portion 5*a* and a conical horn portion 5*b* connected to a front end thereof, the conical horn portion 5*b* having a pointed end formed with an opening 5*c*.

The feedome 6 is constructed by a dielectric material such as AES (acrylonitrile-ethylene-styryl) resin, and comprises a dielectric board 6*a* disposed to be in close contact with the opening 5*c* or adjacent thereto, and a dielectric protrusion 6*b* fixedly mounted substantially in the center of the inner side of the dielectric board 6*a*. The dielectric board 6*a* is formed like a disc having an outer peripheral end as bent slightly, and is constructed to have a thickness t sufficiently smaller than the wavelength of the radio wave in the dielectric board 6*a*. The dielectric protrusion 6*b* is formed like a cylinder, a height h of which is determined to be approximately equal to an integral number times $(1/2)\cdot\lambda$ where the wavelength of the radio wave in the dielectric protrusion 6*b* is $\lambda$. Moreover, a diameter d of the dielectric protrusion 6*b* is determined to be approximately equal to the height h. In other words, the height h and diameter d of the dielectric protrusion 6*b* are determined to be approximately equal to an integral number times (1, 2, 3, 4 . . . ) a half wavelength.

In this embodiment, on the assumption that the primary radiator 4 is applied with linearly polarized wave in the vicinity of a 12 GHz band, the thickness t of the dielectric board 6*a*, the height h of the dielectric protrusion 6*b*, the diameter d of the dielectric protrusion 6*b*, a dielectric constant $\epsilon$ (the wavelength $\lambda$ of radio wave in the feedome 6 is 15–16 mm), a diameter A of the opening 5*c* of the radiator main body 5, and a distance L between the opening 5*c* of the radiator main body 5 and the dielectric board 6*a* of the feedome 6 are determined: t=0.8 mm, h=8.0 mm, d=8.0 mm, $\epsilon$=3.0, A=31 mm, and L=0 mm.

Figure 3:
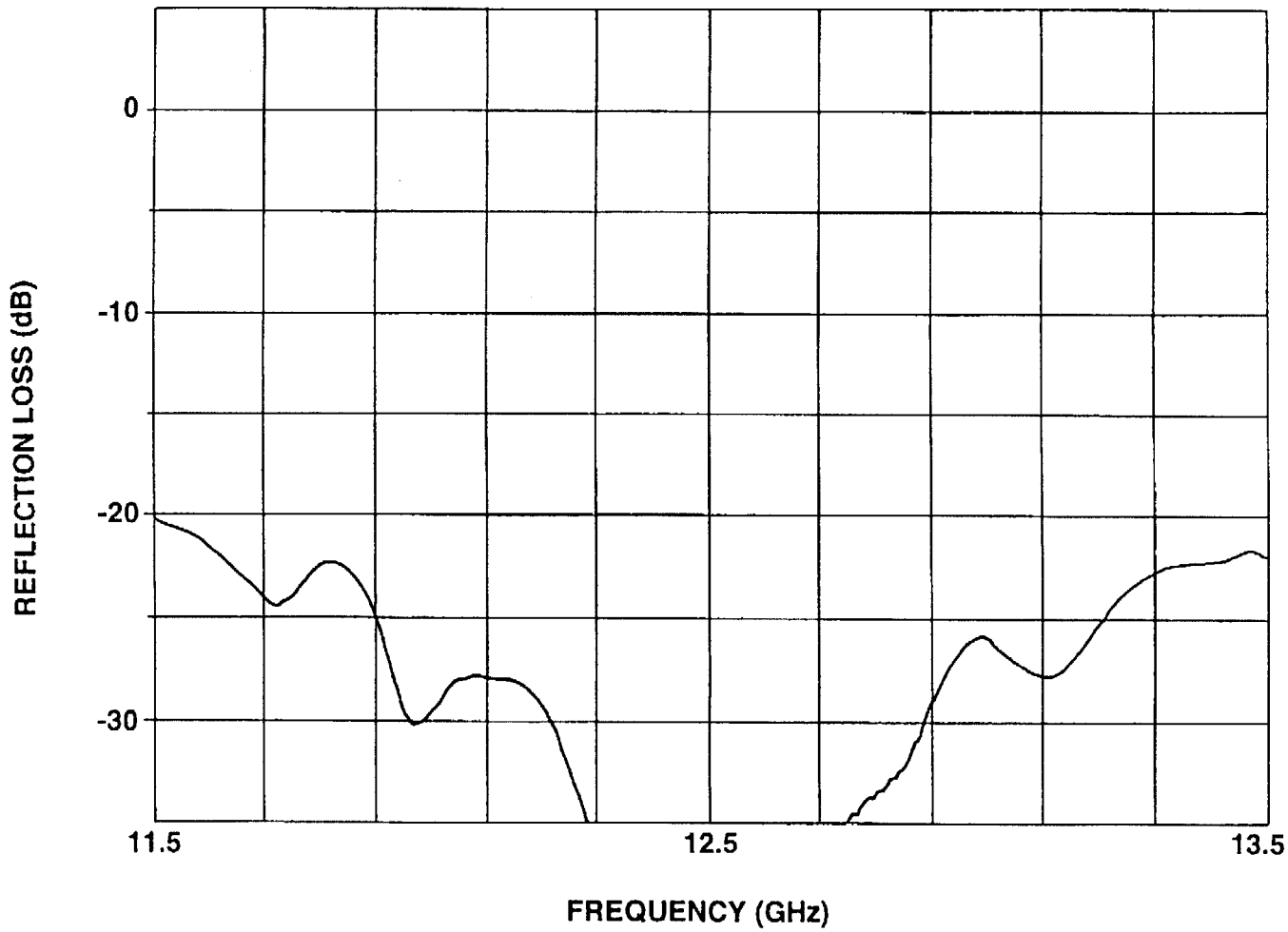
FIG. 3 is a graph showing a reflection loss characteristic of the primary radiator with a feedome disposed.
Figure 4:
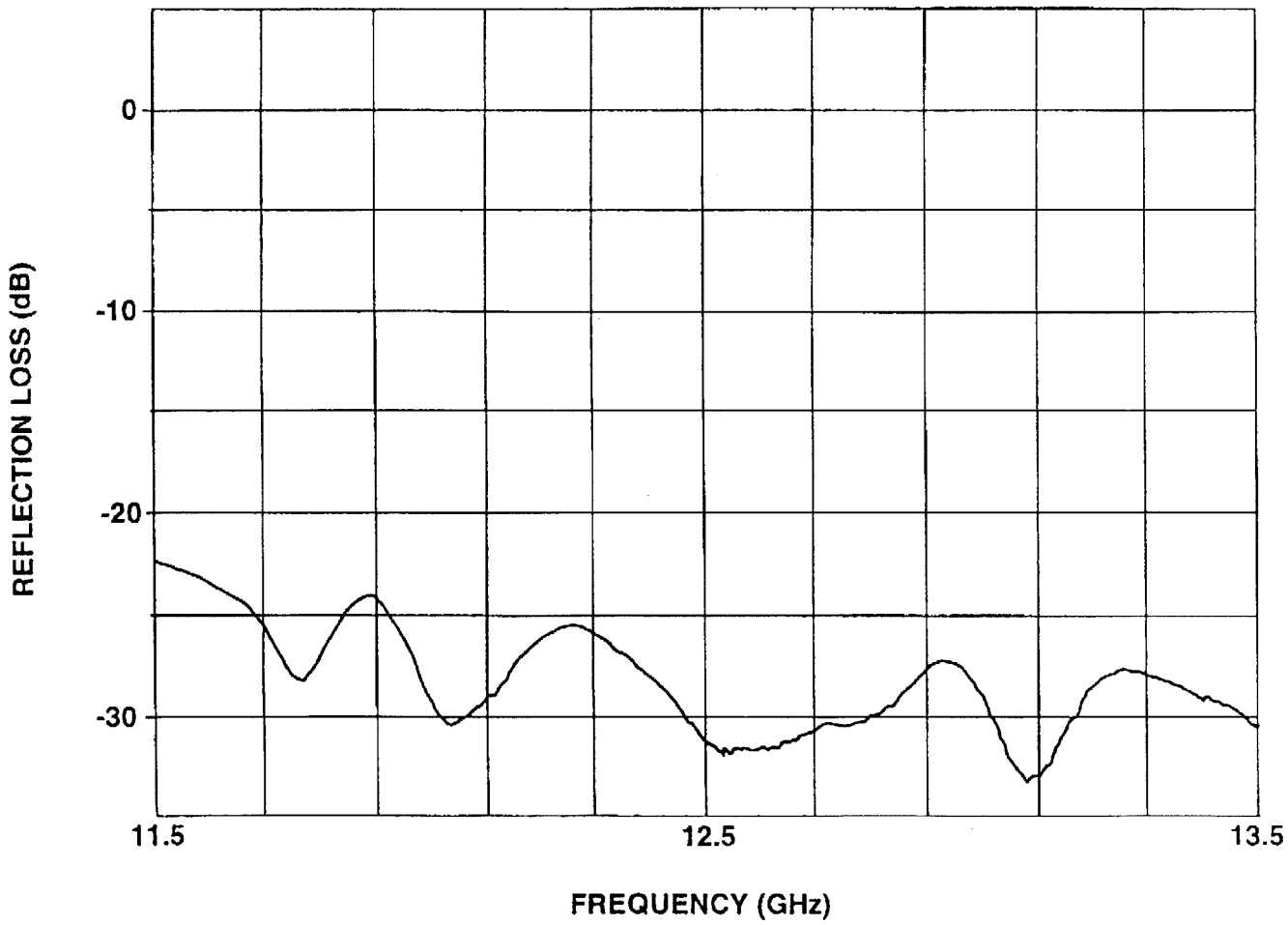
FIG. 4 is a view similar to FIG. 3, showing a reflection loss characteristic of the primary radiator with no feedome disposed.

With the above structure, the radio wave reflected by the reflector 1 goes forward to converge in the vicinity of a focused position. Then, it passes through the feedome 6, and is collected in the radiator main body 5 via the opening 5*c*. A reflection loss characteristic of the above primary radiator 4 is measured, a result of which is as shown in FIG. 3. Moreover, a reflection loss characteristic of the primary radiator 4 with no feedome disposed is measured, a result of which is as shown in FIG. 4. The results of the two measurements reveal that the primary radiator 4 with the feedome 6 has a reflection loss characteristic equivalent to or higher than the primary radiator 4 with no feedome disposed.

Further, since the thickness t of the dielectric board 6*a* of the feedome 6 is 0.8 mm, sufficient strength of the feedome 6 can be obtained. Furthermore, since not only the thickness t of the dielectric board 6*a* of the feedome 6 is 0.8 mm and small, but the dielectric board 6*a* is disposed to be in close contact with the opening 5*c* of the radiator main body 5*c*, and has the dielectric protrusion 6*b* arranged to the inner side of the dielectric board 6*a*, the primary radiator 4 has a reduced size and weight.

Figure 5:
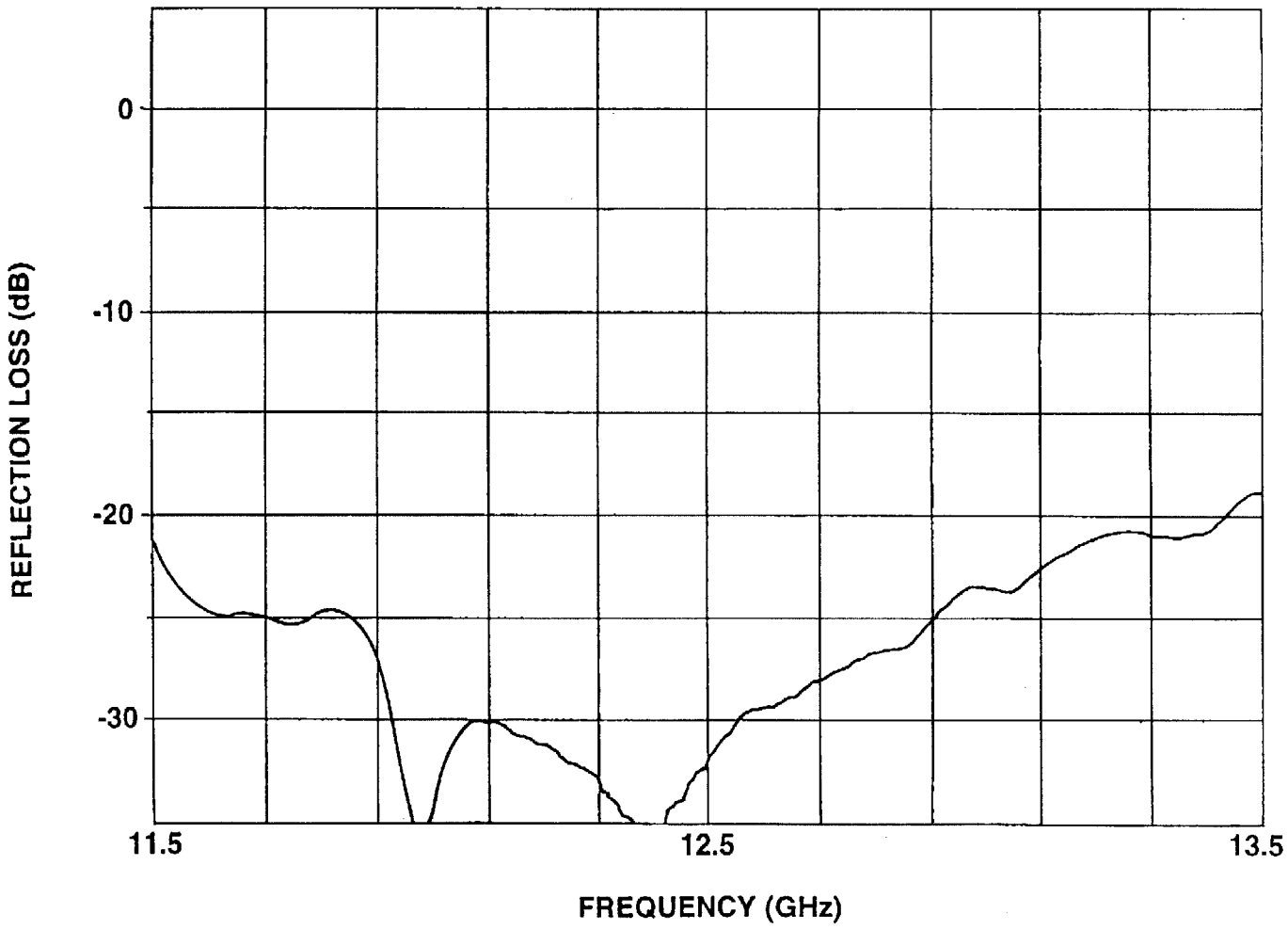
FIG. 5 is a view similar to FIG. 4, showing a reflection loss characteristic of the primary radiator with a feedome disposed.

On the other hand, in this embodiment, when the thickness t of the dielectric board 6*a* of the feedome 6 is determined to 1.1 mm, and the height h of the dielectric protrusion 6*b* is determined to 7.5 mm, and the diameter d is determined to 10.0 mm, a reflection loss characteristic of the primary radiator 4 is excellent as shown in FIG. 5.

Figure 6A:
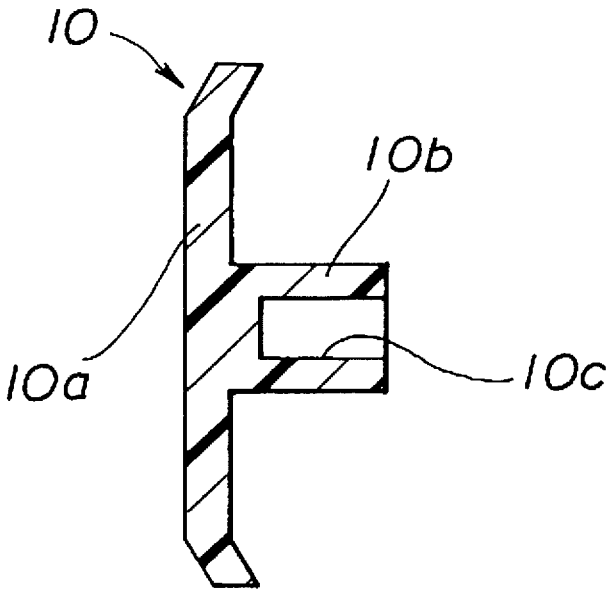
FIG. 6A is a view similar to FIG. 1B, showing a variant of the feedome.
Figure 6B:
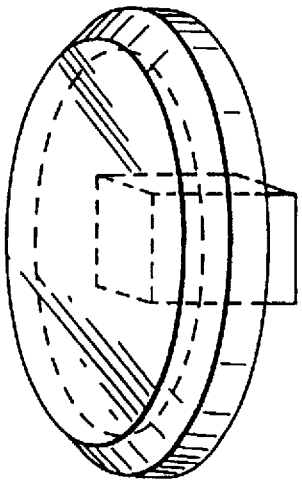
FIG. 6B is a perspective view showing the variant of the feedome.

Referring to FIGS. 6A and 6B, a variant of the feedome will be described. Referring to FIG. 6A, a feedome 10 comprises a dielectric board 10*a* shaped substantially like a disc, and a dielectric protrusion 10*b* shaped substantially like a cylinder in the same way as the above feedome 6, the dielectric protrusion 10*b* having a center portion formed with a cavity 10*c*. With the feedome 10, also, substantially the same reflection loss characteristic as that of the feedome 6 can be obtained with further weight reduction.

It is noted that the shape of the sectional outline of the dielectric protrusion 6*b*, 10*b* may be not circular, and may be polygonal, e.g. quadrangular as shown in FIG. 6B. When the dielectric protrusion 6*b*, 10*b* is formed in a polygon, the length of a diagonal line thereof is determined to be approximately equal to the height thereof.

Further, the primary radiator 4 may be not only of the conical horn type, but of the type of a corrugated horn, multimode horn, etc. Furthermore, the antenna for microwave may not be an offset antenna, and may be a Cassegranian antenna. Still further, polarized wave may be not only linearly polarized wave, but circularly polarized wave.

What is claimed is:

1. A feedome for use in a primary radiator unit of an antenna to prevent rain, dust and other elements from entering an inside portion of said primary radiator, said feedome comprising:

a dielectric board having a thickness sufficiently smaller than a wavelength of a radio wave, said dielectric board having a first side; and a dielectric protrusion fixedly mounted to said dielectric board substantially in a center of said first side thereof, said dielectric protrusion having a height approximately equal to an integral number times $(1/2)\cdot\lambda$ (where said wavelength of the radio wave is $\lambda$) so that said height is significantly larger than the thickness of said dielectric board, and a cross-sectional dimension approximately equal to said height of said dielectric protrusion.

2. A feedome as in claim 1, wherein said dielectric protrusion has a polygonal cross-sectional shape and wherein said cross-sectional dimension is a diagonal line of said polygonal cross-sectional shape.

3. A feedome as in claim 1, wherein said dielectric protrusion has a substantially circular cross-sectional shape and wherein said cross-sectional dimension is a diameter of said circular cross-sectional shape.

4. A feedome as in claim 1, wherein said dielectric protrusion has a substantially solid configuration.

5. A feedome as in claim 1, wherein said dielectric protrusion has a cavity portion which is open to said inside portion of said primary radiator.

6. A primary radiator, comprising:

a main body having an opening on which a radio wave is incident; and a feedome disposed on a side of said opening of said main body for preventing rain, dust and other elements from entering said opening of said main body, said feedome comprising:

a dielectric board disposed with respect to said opening of said main body and having a thickness sufficiently smaller than a wavelength of the radio wave, said dielectric board having a first side; and a dielectric protrusion fixedly mounted to said dielectric board substantially in a center of said first side thereof, said dielectric protrusion having a height approximately equal to an integral number times $(1/2)\cdot\lambda$ (where said wavelength of the radio wave is $\lambda$) so that said height is significantly larger than the thickness of said dielectric board, and a cross-sectional dimension approximately equal to said height of said dielectric protrusion.

7. A primary radiator as claimed in claim 6, wherein said dielectric board is in close contact with said opening of said main body.

8. A primary radiator as claimed in claim 6, wherein said dielectric board is adjacent to said opening of said main body.

9. A primary radiator as in claim 6, wherein said dielectric protrusion has a polygonal cross-sectional shape and wherein said cross-sectional dimension is a diagonal line of said polygonal cross-sectional shape.

10. A primary radiator as in claim 6, wherein said dielectric protrusion has a substantially circular cross-sectional shape and wherein said cross-sectional dimension is a diameter of said circular cross-sectional shape.

11. An antenna for microwave, comprising:

a reflector arranged to reflect a radio wave; and a primary radiator disposed with respect to said reflector, said primary radiator receiving the radio wave reflected by the reflector, said primary radiator comprising a main body having an opening, and a feedome disposed on a side of said opening of said main body for preventing rain, dust and other elements from entering said opening of said main body, said feedome comprising:

a dielectric board disposed with respect to said opening of said main body and having a thickness sufficiently smaller than a wavelength of the radio wave, said dielectric board having a first side; and a dielectric protrusion fixedly mounted to said dielectric board substantially in a center of said first side thereof, said dielectric protrusion having a height approximately equal to an integral number times $(1/2)\cdot\lambda$ (where said wavelength of the radio wave is $\lambda$) so that said height is significantly larger than the thickness of said dielectric board, and a cross-sectional dimension approximately equal to said height of said dielectric protrusion.

12. An antenna as claimed in claim 11, wherein said dielectric board is in close contact with said opening of said main body.

13. An antenna as claimed in claim 11, wherein said dielectric board is adjacent to said opening of said main body.

14. An antenna as in claim 11, wherein said dielectric protrusion has a polygonal cross-sectional shape and wherein said cross-sectional dimension is a diagonal line of said polygonal cross-sectional shape.

15. An antenna as in claim 11, wherein said dielectric protrusion has a substantially circular cross-sectional shape and wherein said cross-sectional dimension is a diameter of said circular cross-sectional shape.

* * * * *